US005293043A

United States Patent [19]

Bonner

[11] Patent Number: 5,293,043

[45] Date of Patent: Mar. 8, 1994

[54] ELECTRODE ASSEMBLY FOR A CORONA TESTER

[75] Inventor: William H. Bonner, Cedarburg, Wis.

[73] Assignee: Pillar Technologies, Hartland, Wis.

[21] Appl. No.: 996,736

[22] Filed: Dec. 24, 1992

[51] Int. Cl.[5] ..... H01T 19/00

[52] U.S. Cl. ..... 250/324; 422/186.05; 422/907

[58] Field of Search ..... 250/324, 325, 326; 361/230; 422/186.05, 907

[56] References Cited

U.S. PATENT DOCUMENTS 4,533,523 8/1985 Ahlbrandt ..... 250/325

4,636,640 1/1987 Majewski ..... 250/324

*Primary Examiner*—Jack I. Berman

*Attorney, Agent, or Firm*—Andrus, Sceales, Starke & Sawall

[57] ABSTRACT

An electrode assembly for a corona treater of the type having an electrode magazine in which at least one high voltage electrode is mounted and a support tube on which the electrode magazine is removably mounted includes a plurality of projections extending outwardly from a mounting block disposed on the support tube and a plurality of projection receiving slots disposed on a pair of exterior guard plates mounted on the electrode magazine so that the electrode magazine may be releasably connected to the support tube by sliding the projections on the mounting block into the slots on the electrode magazine.

8 Claims, 2 Drawing Sheets

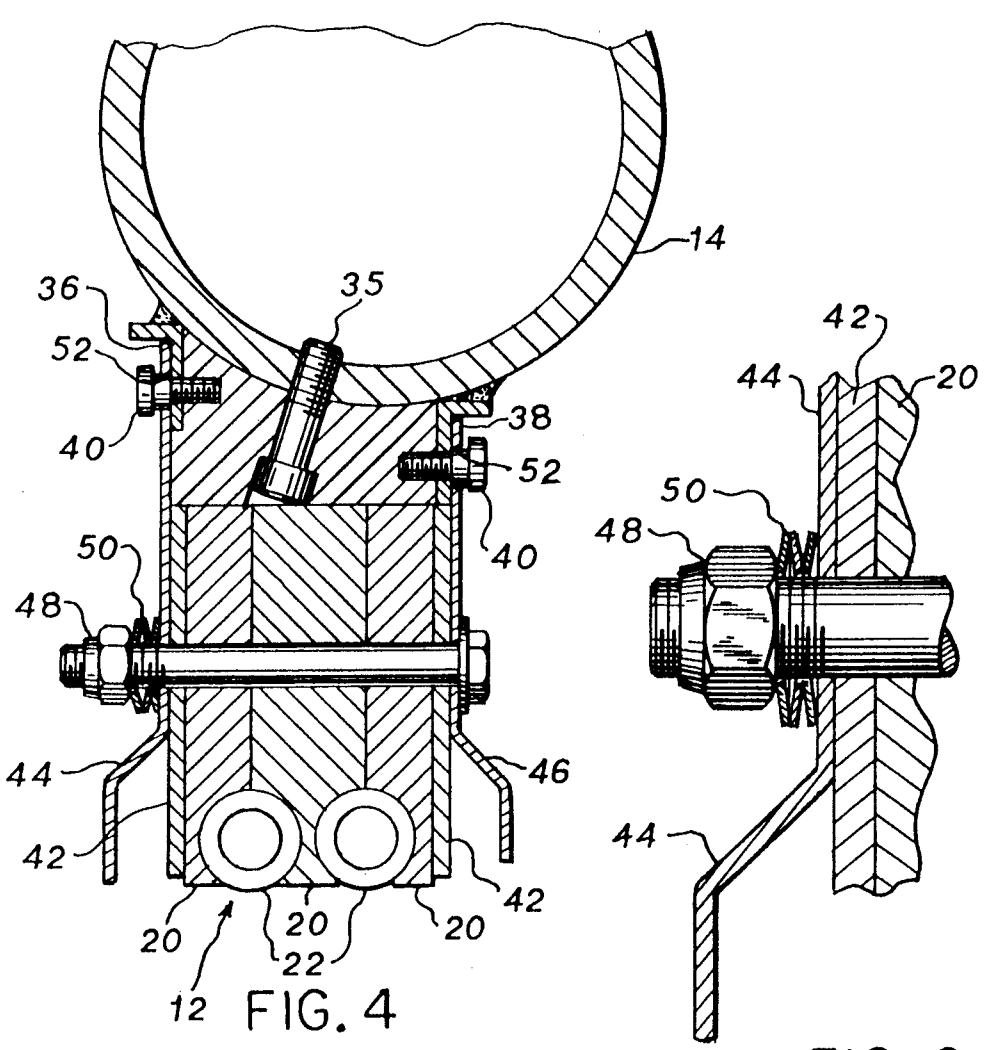
FIG. 4
FIG. 6
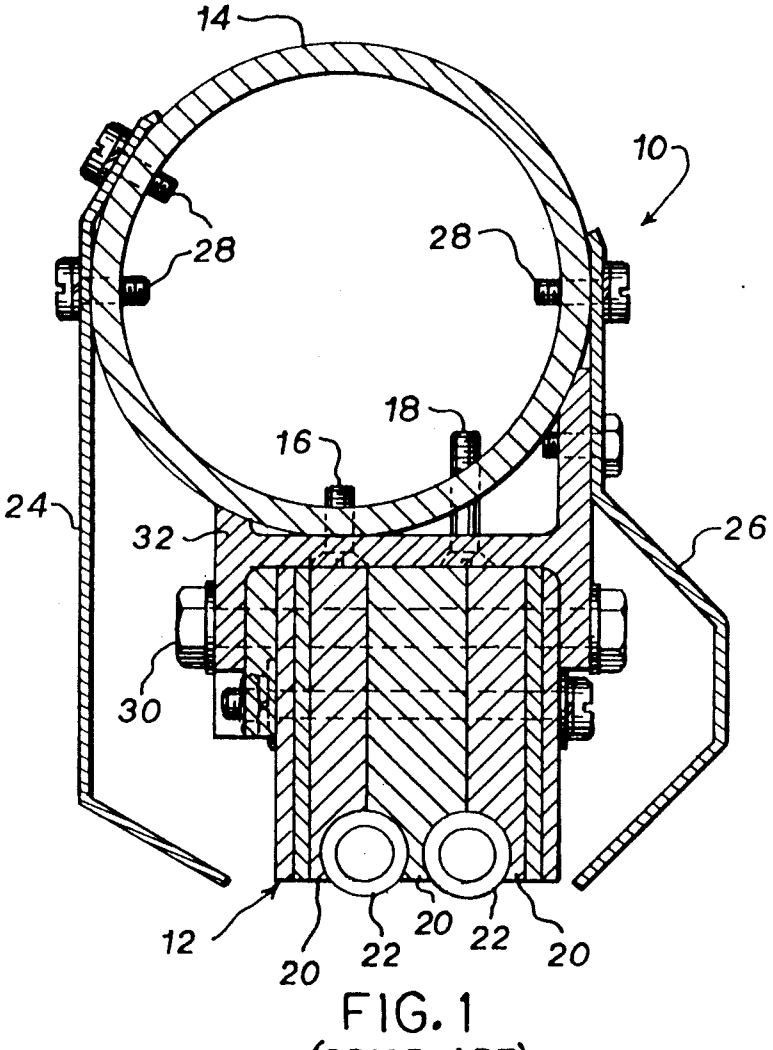
FIG. 1
(PRIOR ART)

ELECTRODE ASSEMBLY FOR A CORONA TESTER

BACKGROUND OF THE INVENTION

The present invention relates to corona treaters and more specifically to the assembly and connection between the electrode assembly of the corona treater and the support tube. A corona treater utilizes an electrode assembly that must be periodically removed from the corona treater. In the past, the removal of the electrode assembly required the removal of a pair of guards on either side of the assembly and the subsequent removal of bolts that held the electrode assembly to the support tube.

A high voltage wire then had to be lubricated and disconnected in order to remove it from the support tube. Applicant's co-pending application Ser. No. 07/974,909 is directed to the problems associated with the high voltage connection and when used in conjunction with the invention described herein greatly facilitates the cleaning and/or repair of the electrode assembly.

In the past, electrode assemblies have been pivotally attached to the support tube, but this arrangement merely facilitated the cleaning of the electrodes and did not provide a solution for the replacement of the high voltage electrodes in the electrode assembly.

The purpose of the present invention is to provide a simple connection between the electrode assembly and the support tube so that the electrode assembly can be easily removed from the support tube for cleaning and/or repair of the high voltage electrodes.

SUMMARY OF THE INVENTION

An electrode assembly for a corona treater of the type having an electrode magazine in which at least one high voltage electrode is mounted and a support tube on which the electrode magazine is removably mounted includes a plurality of projections extending outwardly from opposed side walls of a mounting block on the support tube.

In accordance with one aspect of the invention, the electrode magazine is provided with opposed exterior guard plates having a plurality of projection receiving slots disposed therein.

In accordance with yet another aspect of the invention, the electrode assembly includes a locking mechanism for maintaining the projections within the slots.

In accordance with still another aspect of the invention, the slots are substantially L-shaped with a short leg and a long leg and the projections are disposed in the long leg when the electrode magazine is mounted on the support tube.

BRIEF DESCRIPTION OF THE DRAWINGS

The drawings illustrate the best mode presently contemplated of carrying out the invention.

In the drawings:

FIG. 1 is a side cross-sectional view of a prior art electrode assembly;

FIG. 4 is a sectional view along the line 4—4 of FIG. 2;

FIG. 6 is an enlarged cross-sectional view of the electrode magazine parts assembly.

DETAILED DESCRIPTION OF THE PREFERRED EMBODIMENT

Figure 2:
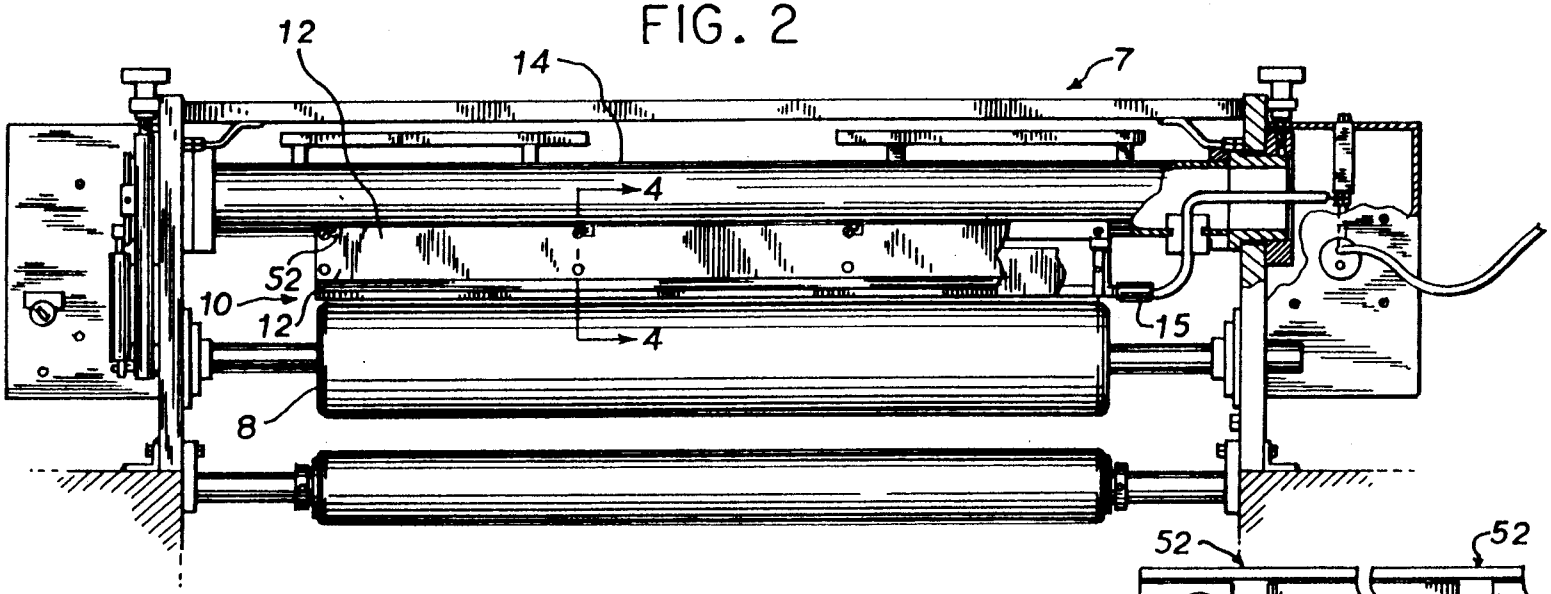
FIG. 2 is a front view of a corona treater constructed according to the present invention.
Figure 3:
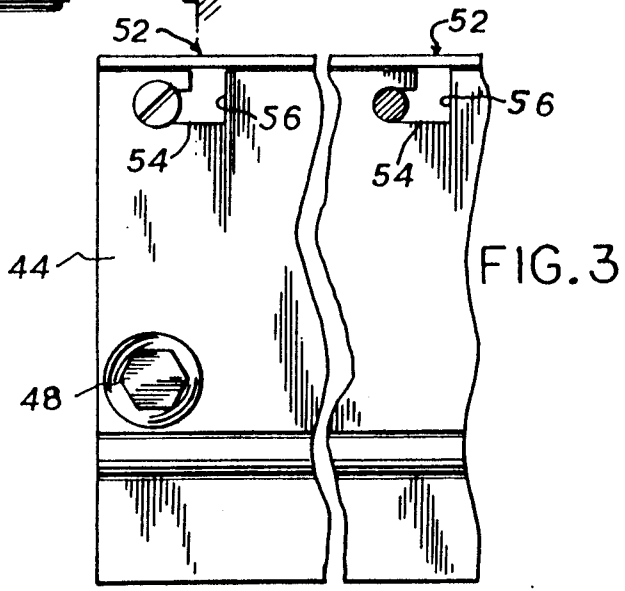
FIG. 3 is an enlarged front view of the connection between the electrode magazine and the support tube.
Figure 5:
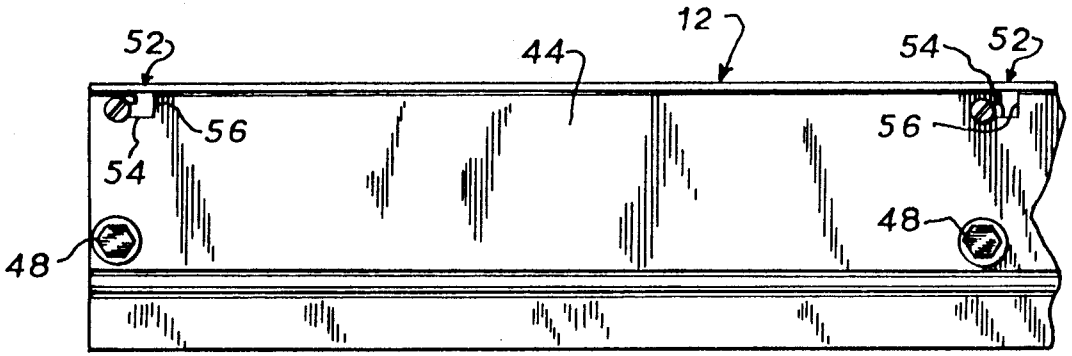
FIG. 5 is an enlarged front view of the connection between the electrode magazine and the support tube.

As seen in FIG. 2, a corona treater 7 treats a web of material (not shown) that passes over roller 8 in close proximity to high voltage electrodes 22 disposed in electrode magazine 12. Electrode magazine 12 is disposed on support tube 14 and connected to a source of high voltage by connector 15. Rotation of support tube 14 moves electrode magazine 12 in and out of position adjacent roller 8.

FIG. 1 illustrates a prior art electrode assembly 10 in which an electrode assembly 12 was mounted to a support tube 14 by means of bolts 16 and 18. Electrode assembly 12 utilizes a plurality of molded porcelain holder blocks 20 to hold a pair of high voltage electrodes 22. A pair of guard plates 24 and 26 were mounted to support tube 14 by means of bolts 28.

During the course of use, electrode assembly 12 must be cleaned and/or electrodes 22 must be replaced. In the prior art assembly of FIG. 1, this necessitated the removal of guards 24 and 26 in order to obtain access to bolt 30. Bolt 30 was then removed and electrode assembly 12 was slidably removed from mounting block 32. This procedure, when combined with the disassembly of the high voltage connection, made the cleaning of electrode assembly 12 and the replacement of electrodes 22 extremely labor intensive.

In the present invention, support tube 14 is provided with a mounting block 34 that is mounted to support tube 14 by bolt 35 and that extends outwardly from support tube 14. Mounting block 34 has opposed side walls 36 and 38. A plurality of projections 40 in the form of raised threaded members are disposed and extend from each of side wails 36 and 38.

Electrode magazine 12 includes a pair of electrodes 22 slidably mounted in porcelain holder blocks 20. An insulation board 42 is disposed between holder blocks 20 and guard plates 44 and 46. The entire assembly is held together by a series of bolts 48 that are provided with spring tensioned washers 50 that allow for the expansion and contraction of electrode magazine 12. Each of guard plates 44 and 46 is provided with a plurality of L-shaped slots 52 having a long leg 54 and a short leg 56. Slots 52 accept projections 40 when electrode magazine 12 is mounted on support tube 14.

In operation, electrode magazine 12 is mounted to support tube 14 by aligning short leg 56 of slot 52 with the projections 40. Magazine 12 is then pushed onto support tube 14 and moved laterally so that projections 40 are moved into long leg 54. One or more of threaded projections 40 may then be tightened so as to secure projection 40 within slot 52. V%Then cleaning of electrode magazine 12 and/or replacement of electrodes 22 becomes necessary, tightened projection 40 is loosened and electrode magazine 12 is slid off of projections 40.

The present invention thus provides an electrode assembly for a corona treater in which the electrode magazine may be easily removed from the support tube for cleaning and/or replacement of the electrodes.

Various modes of carrying out the invention are contemplated as being within the scope of the following claims particularly pointing out and distinctly claiming the subject matter regarded as the invention.

I claim:

1. An improved electrode assembly for a corona treater of the type having an electrode magazine in which at least one high voltage electrode is mounted and a support tube on which the electrode magazine is removably mounted, the improvement comprising:

a plurality of projections on either of the electrode magazine or the support tube, and a plurality of projection receiving slots on the other of the electrode magazine or the support tube such that the electrode magazine may be removably mounted on the support tube by sliding said projections into said slots.

2. The improved electrode assembly defined in claim 1 wherein the support tube is provided with a mounting block and said projections extend from said mounting block.

3. The improved electrode assembly defined in claim 1 wherein the electrode magazine is provided with an exterior guard plate and said slots are disposed in said guard plate.

4. The improved electrode assembly defined in claim 2 wherein said mounting block has a pair of opposed side walls extending outwardly from the support tube and said projections extend from each of said side walls.

5. The improved electrode assembly of claim 3 wherein the electrode magazine has a pair of opposed exterior guard plates and said slots are disposed in each of said guard plates.

6. The improved electrode assembly of claim 1 wherein said slots are substantially L-shaped with a short leg and a long leg and said projections are disposed in said long leg when the electrode magazine is mounted on the support tube.

7. The improved electrode assembly of claim 1 further comprising locking means for maintaining said projections in said slots.

8. An improved electrode assembly for a corona treater of the type having an electrode magazine in which at least one high voltage electrode is mounted and a support tube on which the electrode magazine is removably mounted, the improvement comprising:

a mounting block disposed on the support tube and having a pair of opposed side walls extending outwardly from the support tube, a plurality of projections disposed on and extending from said side walls, a pair of opposed exterior guard plates mounted on the electrode magazine, and a plurality of projection receiving slots disposed in each of said guard plates such that the electrode magazine may be removably mounted on the support tube by sliding said projections into said slots.

* * * * *

UNITED STATES PATENT AND TRADEMARK OFFICE

CERTIFICATE OF CORRECTION

PATENT NO. : 5,293,043

DATED : March 8, 1994

INVENTOR(S) : WILLIAM H. BONNER

It is certified that error appears in the above-identified patent and that said Letters Patent is hereby corrected as shown below:

On title page, item [54] and col. 1, line 2,

"TESTER" should be ---TREATER---

Signed and Sealed this

Fifth Day of July, 1994

Bruce Lehman

*Attest:*

BRUCE LEHMAN

*Attesting Officer*

*Commissioner of Patents and Trademarks*